US010289019B2

(12) United States Patent
Kakutani et al.

(10) Patent No.: US 10,289,019 B2
(45) Date of Patent: May 14, 2019

(54) IMAGE FORMING APPARATUS THAT CONTROLS CLEANING ABILITY OF CLEANER AND CONTROL METHOD THEREOF

(71) Applicant: Brother Kogyo Kabushiki Kaisha, Nagoya-shi, Aichi-ken (JP)

(72) Inventors: Hotaka Kakutani, Kiyosu (JP); Kazutoshi Kotama, Toyota (JP); Chieko Mimura, Nagoya (JP); Kengo Yada, Seki (JP); Shota Iriyama, Toyokawa (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 15/938,235

(22) Filed: Mar. 28, 2018

(65) Prior Publication Data

US 2019/0004461 A1 Jan. 3, 2019

(30) Foreign Application Priority Data

Jun. 30, 2017 (JP) ..... 2017-128707

(51) Int. Cl.
*G03G 15/00* (2006.01)
*G03G 15/02* (2006.01)

(52) U.S. Cl.
CPC ..... *G03G 15/0225* (2013.01); *G03G 15/0258* (2013.01); *G03G 15/50* (2013.01); *G03G 2215/021* (2013.01)

(58) Field of Classification Search
CPC . G03G 15/0225; G03G 15/0258; G03G 15/50
See application file for complete search history.

(56) References Cited

U.S. PATENT DOCUMENTS 5,557,373 A * 9/1996 Miyashita ..... G03G 15/0225 399/176
8,886,065 B2 11/2014 Kondo
9,002,223 B2 4/2015 Yada et al.
2003/0039494 A1* 2/2003 Shakuto ..... G03G 15/0225 399/357

(Continued)

FOREIGN PATENT DOCUMENTS

JP 2012-032531 A 2/2012
JP 2013-156384 A 8/2013

(Continued)

*Primary Examiner* — Carla J Therrien
(74) *Attorney, Agent, or Firm* — Banner & Witcoff, Ltd.

(57) ABSTRACT

An image forming apparatus configured to, in a case where a difference between a charging current flowing through a first charging roller and a charging current flowing through a second charging roller is larger than a first threshold value, perform first cleaning processing in which a cleaning ability of one cleaner of a first cleaner and a second cleaner, which corresponds to one of the first charging roller and the second charging roller, is lower than a cleaning ability of another cleaner of the first cleaner and the second cleaner, which corresponds to another of the first charging roller and the second charging roller, a charging current flowing through the one charging roller being larger than a charging current flowing through the other charging roller.

12 Claims, 7 Drawing Sheets

(56) References Cited

U.S. PATENT DOCUMENTS

| | | | | |
|---|---|---|---|---|
| 2009/0060554 | A1* | 3/2009 | Kosuge | G03G 15/0225 399/71 |
| 2012/0027436 | A1 | 2/2012 | Maruyama et al. | |
| 2013/0195476 | A1 | 8/2013 | Yada et al. | |
| 2013/0195480 | A1 | 8/2013 | Kondo | |
| 2014/0356006 | A1* | 12/2014 | Adachi | G03G 21/0064 399/50 |

FOREIGN PATENT DOCUMENTS

| | | | |
|---|---|---|---|
| JP | 2013-156385 | A | 8/2013 |
| JP | 2013-156386 | A | 8/2013 |
| JP | 2015-001656 | A | 1/2015 |

* cited by examiner

IMAGE FORMING APPARATUS THAT CONTROLS CLEANING ABILITY OF CLEANER AND CONTROL METHOD THEREOF

CROSS-REFERENCE TO RELATED APPLICATIONS

This application claims priority from Japanese Patent Application No. 2017-128707 filed on Jun. 30, 2017, the entire contents of which are incorporated herein by reference.

TECHNICAL FIELD

The present disclosure relates to an image forming apparatus including a cleaner configured to collect foreign matters on a surface of a charging roller, a control method of the image forming apparatus, and a storage medium storing instructions to be executed by a computer of an image forming apparatus.

BACKGROUND

In the related art, an image forming apparatus has been known which includes a plurality of photosensitive members, a plurality of charging rollers configured to charge the photosensitive members, and a plurality of cleaners configured to collect foreign matters attached on surfaces of the charging rollers. For example, related art discloses an image forming apparatus in which a braking member is pressed to a core metal of a cleaning roller, which is a cleaner, to apply a rotational load, so that a peripheral speed of the cleaning roller relative to the charging roller is slowed down or the cleaning roller is stopped to increase a peripheral speed difference between the charging roller and the cleaning roller, thereby increasing a cleaning ability.

SUMMARY

According to an aspect of the present disclosure, there is provided an image forming apparatus including: a first photosensitive member; a second photosensitive member; a first charging roller configured to charge the first photosensitive member; a second charging roller configured to charge the second photosensitive member; a first cleaner configured to collect foreign matters on a surface of the first charging roller; a second cleaner configured to collect foreign matters on a surface of the second charging roller; a charging power supply common to the first charging roller and the second charging roller and configured to apply a same charging voltage to the first charging roller and the second charging roller; and a control device configured to, in a case where a difference between a charging current flowing through the first charging roller and a charging current flowing through the second charging roller is larger a first threshold value, perform first cleaning processing in which a cleaning ability of one cleaner of the first cleaner and the second cleaner, which corresponds to one of the first charging roller and the second charging roller, is lower than a cleaning ability of another cleaner of the first cleaner and the second cleaner, which corresponds to another of the first charging roller and the second charging roller, a charging current flowing through the one charging roller being larger than a charging current flowing through the other charging roller.

According to another aspect of the present disclosure, there is provided a control method for controlling an image forming apparatus including: a first photosensitive member; a second photosensitive member; a first charging roller configured to charge the first photosensitive member; a second charging roller configured to charge the second photosensitive member; a first cleaner configured to collect foreign matters on a surface of the first charging roller; a second cleaner configured to collect foreign matters on a surface of the second charging roller; and a charging power supply common to the first charging roller and the second charging roller and configured to apply a same charging voltage to the first charging roller and the second charging roller, the method including: in a case where a difference between a charging current flowing through the first charging roller and a charging current flowing through the second charging roller is larger a first threshold value, performing first cleaning processing in which a cleaning ability of one cleaner of the first cleaner and the second cleaner, which corresponds to one of the first charging roller and the second charging roller, is lower than a cleaning ability of another cleaner of the first cleaner and the second cleaner, which corresponds to another of the first charging roller and the second charging roller, a charging current flowing through the one charging roller being larger than a charging current flowing through the other charging roller.

According to another aspect of the present disclosure, there is provided an image forming apparatus including: a first photosensitive drum; a second photosensitive drum; a first charging roller configured to charge the first photosensitive drum; a second charging roller configured to charge the second photosensitive drum; a first cleaner configured to collect foreign matters on a surface of the first charging roller; a second cleaner configured to collect foreign matters on a surface of the second charging roller; a charging power supply common to the first charging roller and the second charging roller and configured to apply a same charging voltage to the first charging roller and the second charging roller; a cleaning power supply common to the first cleaner and the second cleaner, the cleaning power supply configured to apply a cleaning voltage which has a same polarity as the charging voltage and an absolute value larger than the charging voltage to the first cleaner and the second cleaner; and a control device including an electric circuit and configured to output a control signal to the charging power supply and the cleaning power supply, wherein, in a case where a first charging current flowing through the first charging roller is larger than a second charging current flowing through the second charging roller, the control device is configured to apply a cleaning voltage to the second cleaner by the cleaning power supply and not apply a cleaning voltage to the first cleaner by the cleaning power supply.

According to the aspects of present disclosure, since the degrees of contamination of the surfaces of the charging rollers can be controlled to be substantially the same, it is possible to maintain high image quality.

DETAILED DESCRIPTION

Figure 1:
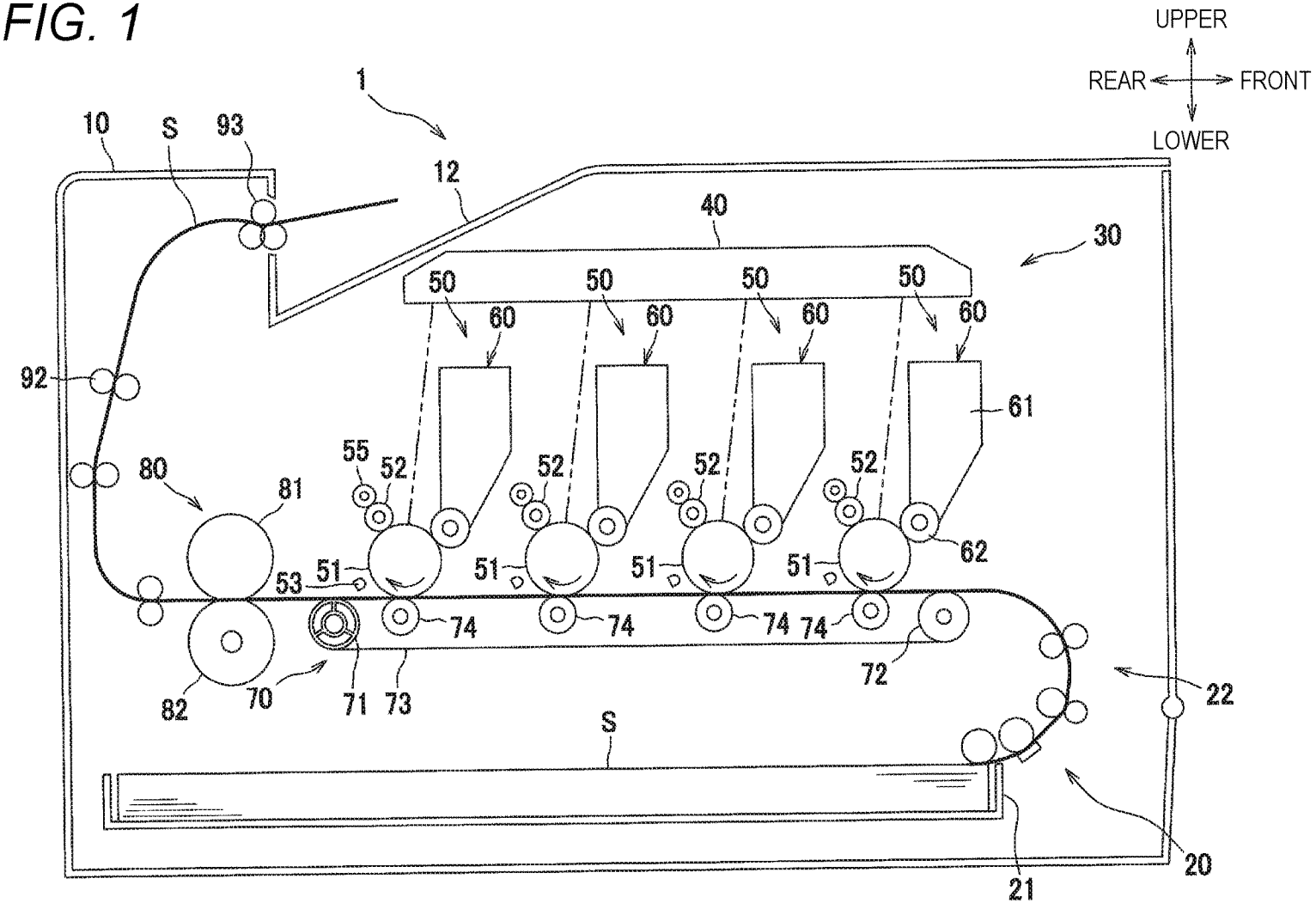
FIG. 1 depicts a configuration of an image forming apparatus of an illustrative embodiment.

Hereinafter, an illustrative embodiment of the present disclosure will be described with reference to the drawings. Meanwhile, in the below, after describing in brief a configuration of the image forming apparatus, features of the present disclosure will be then described in detail. Also, in the following descriptions, regarding the directions, a right side in FIG. 1 is referred to as 'front', a left side is referred to as 'rear', a front side is referred to as 'right' and a back side is referred to as 'left'. Also, in FIG. 1, an upper side is referred to as 'upper' and a lower side is referred to as 'lower'.

As shown in FIG. 1, a color printer 1, which is an example of the image forming apparatus, includes a main body housing 10, a feeder unit 20, and an image forming unit 30.

The feeder unit 20 is provided at a lower part in the main body housing 10, and includes a feeder tray 21 and a feeder mechanism 22. The feeder unit 20 is configured to separate sheets S accommodated in the feeder tray 21 one by one and to feed the same to the image forming unit 30 by the feeder mechanism 22.

The image forming unit 30 includes an exposure device 40, process units 50, a transfer unit 70, and a fixing device 80.

The exposure device 40 is arranged at an upper part in the main body housing 10, and includes a plurality of laser light sources, a polygon mirror, a lens, a reflector and the like, which are not shown. The exposure device 40 is configured to scan light beams (refer to dashed-two dotted line) based on image data at high speed on surfaces of photosensitive drums 51, thereby exposing the surfaces of the photosensitive drums 51.

The four process units 50 are aligned side by side in a front and rear direction between the feeder tray 21 and the exposure device 40. The process units 50 have a photosensitive drum 51, a charging roller 52 configured to charge the photosensitive drum 51, and a developing device 60, respectively. The developing device 60 includes an accommodation unit 61 configured to accommodate therein positively charged toner, a developing roller 62 configured to supply the toner to the photosensitive drum 51, and the like.

The transfer unit 70 is provided between the feeder tray 21 and the process units 50, and includes a driving roller 71, a driven roller 72, an endless conveyor belt 73 stretched between the driving roller 71 and the driven roller 72, and four transfer rollers 74. An outer surface of the conveyor belt 73 is in contact with the respective photosensitive drums 51, and the respective transfer rollers 74 are arranged at an inner side of the conveyor belt so as to sandwich the conveyor belt 73 between the respective transfer rollers and the respective photosensitive drums 51.

The fixing device 8 is arranged at the rear of the process units 50 and the transfer unit 70, and includes a heating roller 81 and a pressing roller 82 arranged to face the heating roller 81 and pressing the heating roller 81.

The image forming unit 30 is configured to charge surfaces of the photosensitive drums 51 by the charging rollers 52 to which a positive charging voltage is applied and to expose the surfaces of the photosensitive drums 51 by the exposure device 40, thereby forming electrostatic latent images on the photosensitive drums 51. Then, the image forming unit 30 is configured to supply toners carried on the developing rollers 62 to the electrostatic latent images formed on the photosensitive drums 51 and to visualize the electrostatic latent images, thereby forming toner images on the photosensitive drums 51. Then, the image forming unit 30 is configured to convey the sheet S fed from the feeder unit 20 between the photosensitive drums 51 and the transfer rollers 74 to which a negative transfer voltage is applied, thereby transferring the toner images formed on the photosensitive drums 51 to the sheet S. Then, the image forming unit 30 is configured to convey the sheet S having the toner images transferred thereto between the heating roller 81 and the pressing roller 82, thereby heat-fixing the toner images to form an image on the sheet S. The sheet S having the image formed thereon is discharged onto a sheet discharge tray 12 by conveyor rollers 92 and discharge rollers 93.

The process units 50 include a neutralization lamp 53 and a cleaning roller 55, respectively, in addition to the photosensitive drum 51, the charging roller 52 and the developing device 60.

The neutralization lamp 53 is configured to reduce charges remaining on the surface of the photosensitive drum 51 after the transfer by irradiating light to the surface of the photosensitive drum 51 after the toner image is transferred. The neutralization lamp 53 is arranged to face the photosensitive drum 51 at a position that is downstream of a position, at which the photosensitive drum 51 and the transfer roller 74 face each other, and upstream of a position, at which the photosensitive drum 51 and the charging roller 52 face each other, with respect to a rotation direction of the photosensitive drum 51.

The cleaning roller 55 is configured to collect foreign matters on the surface of the charging roller 52. The foreign matters on the surface of the charging roller 52 are foreign matters having moved from the surface of the photosensitive drum 51 to the surface of the charging roller 52. When the foreign matters are attached on the surface of the photosensitive drum 51, the foreign matters may move from the surface of the photosensitive drum 51 to the surface of the charging roller 52, thereby contaminating the surface of the charging roller 52. The foreign matters attached on the surface of the photosensitive drum 51 are toners, which remain on the photosensitive drum 51 without being transferred to the sheet S, external additives such as silica, paper dusts and the like.

The cleaning roller 55 is a roller having a conductive urethane rubber layer or the like coated on a metallic shaft, is arranged to be in contact with the surface of the charging roller 52, and is configured to rotate in association with rotation of the charging roller 52. In a case of collecting the foreign matters on the surface of the charging roller 52, a cleaning voltage, which has the same polarity as the charging voltage and an absolute value higher than the charging voltage, is applied from cleaning power supplies 310, 320

(which will be described later) to the shaft of the cleaning roller 55. Thereby, the negatively charged toners, paper dusts and the like of the foreign matters on the surface of the charging roller 52 are collected by the cleaning roller 55.

The cleaning voltage is set to a value at which an electric discharge phenomenon does not occur between the cleaning roller 55 and the charging roller 52. For example, the cleaning voltage can be set to a voltage of about +500V relative to the charging voltage, and is preferably lower than +600V relative to the charging voltage so that the electric discharge phenomenon does not occur.

Figure 2:
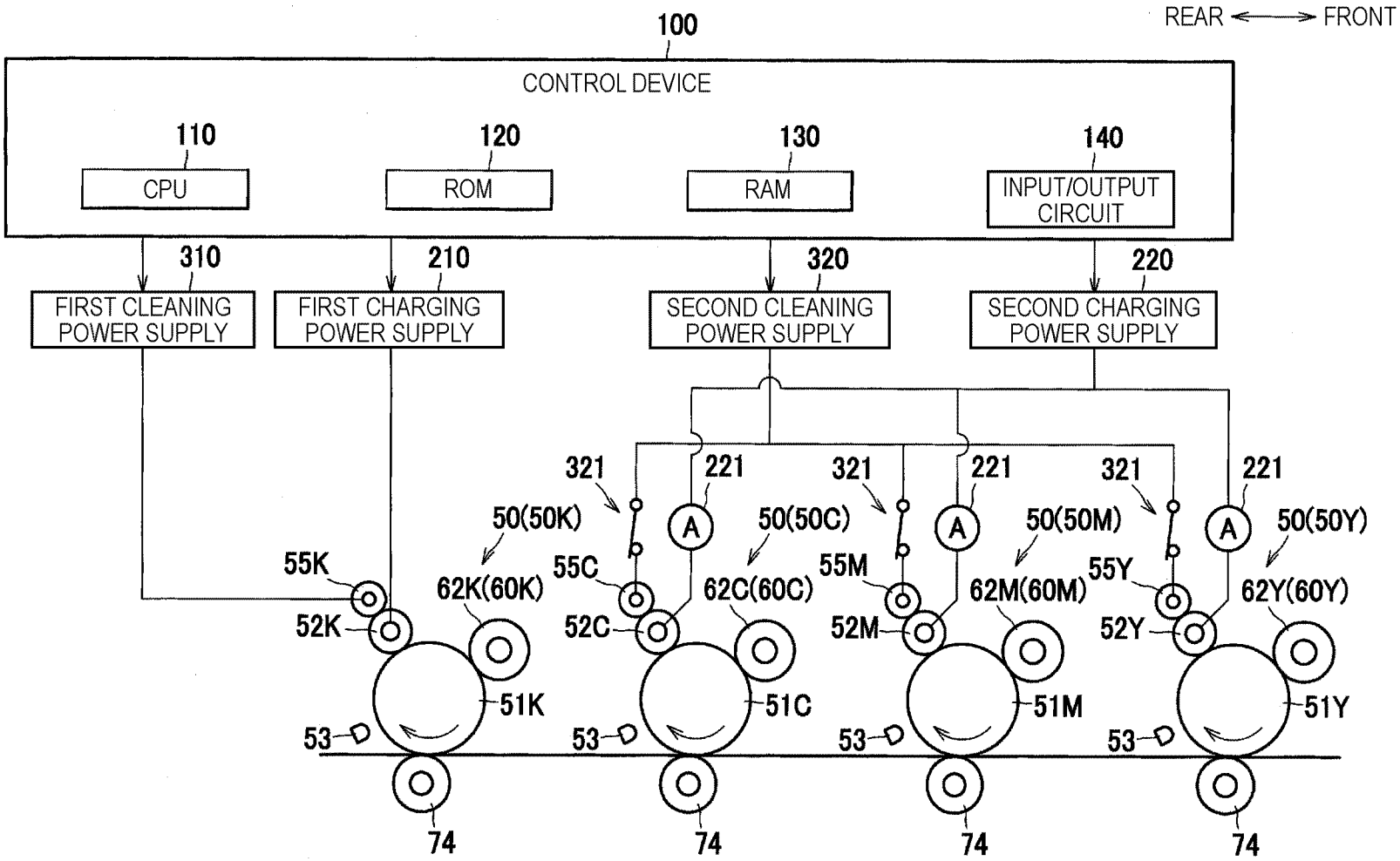
FIG. 2 depicts configurations of process units in which developing devices are located at adjacent positions, each power supply and a control device.

As shown in FIG. 2, the process units 50 are arranged in order of the process units 50Y, 50M, 50C, 50K from the front toward the rear, which include developing devices 60Y, 60M, 60C, 60K having toners of yellow (Y), magenta (M), cyan (C) and black (K) accommodated therein. In the specification and drawings, symbols Y, M, C, K are used in a case of specifying the photosensitive drums 51, the charging rollers 52 and the like corresponding to colors of the toners.

In the illustrative embodiment, regarding the photosensitive drum 51, the charging roller 52, the neutralization lamp 53 and the cleaning roller 55, which are components of the process unit 50, the same components are used for all the process units 50.

Figure 3:
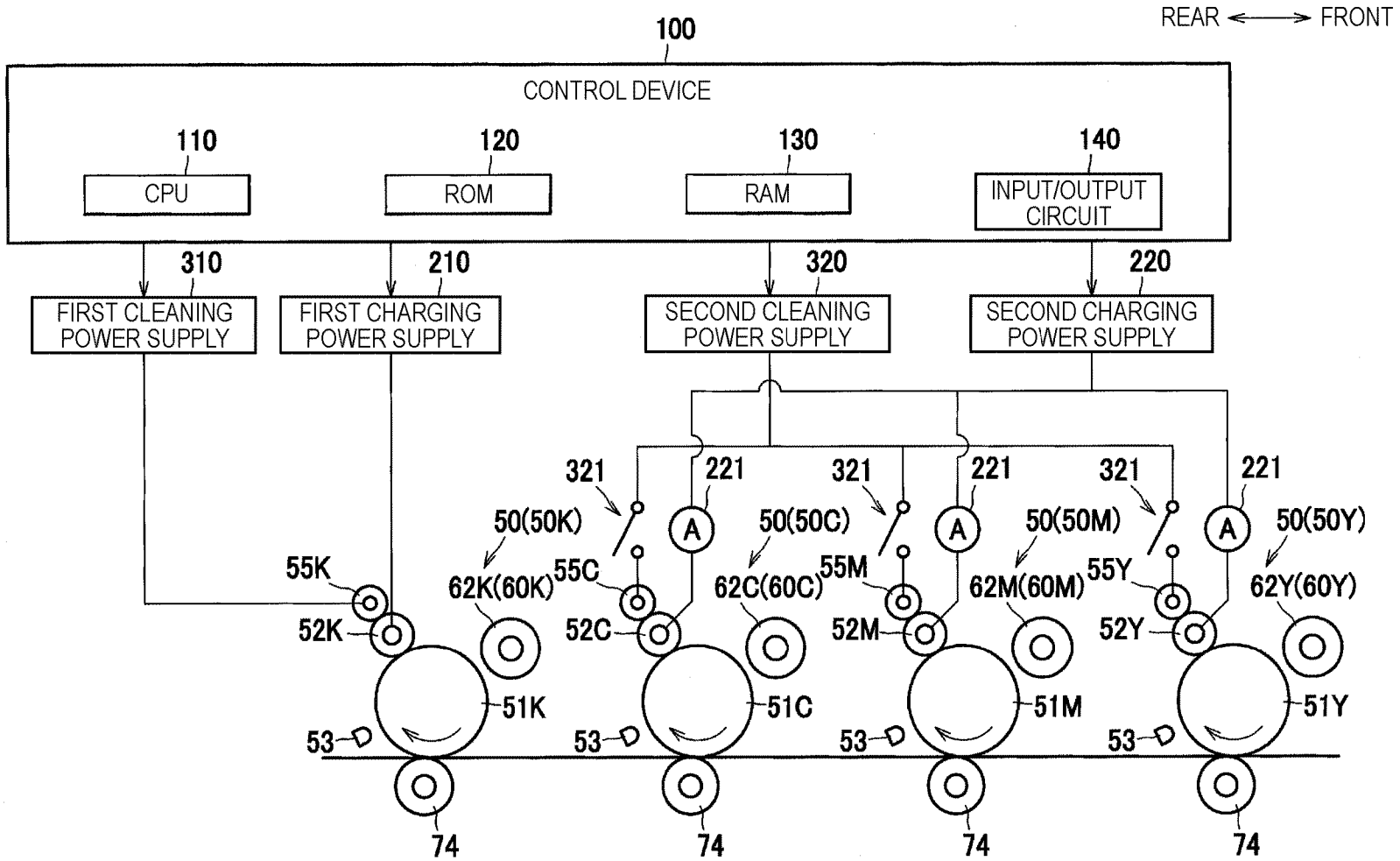
FIG. 3 depicts configurations of the process units in which developing devices are located at spaced positions, each power supply and the control device.

The developing device 60 is configured to be moveable between an adjacent position shown in FIG. 2 at which the developing roller 62 comes close to the photosensitive drum 51 and a spaced position shown in FIG. 3 at which the developing roller 62 is more distant from the photosensitive drum 51 than at the adjacent position by an approach and separation mechanism (not shown). The adjacent position is a position at which the toner can be supplied from the developing roller 62 to the photosensitive drum 51, and the spaced position is a position at which the toner cannot be supplied from the developing roller 62 to the photosensitive drum 51. In the meantime, the adjacent position may be a position at which the developing roller 62 is in contact with the surface of the photosensitive drum 51 or a position at which the developing roller 62 is slightly distant from the surface of the photosensitive drum 51, inasmuch as the toner can be supplied.

As shown in FIG. 2, the color printer 1 includes a control device 100, a first charging power supply 210, a second charging power supply 220 which is an example of the charging power supply, a first cleaning power supply 310, and a second cleaning power supply 320 which is an example of the cleaning power supply.

The first charging power supply 210 is a power supply configured to apply a charging voltage to the charging roller 52K, and is connected to the charging roller 52K. In a case of applying a charging voltage to the charging roller 52K, the control device 100 applies a charging voltage, at which a charging current of the charging roller 52K becomes a predetermined value, to the charging roller 52K by the first charging power supply 210, for example.

The second charging power supply 220 is a power supply common to the charging rollers 52Y, 52M, 52C, is configured to apply the same charging voltage to the charging rollers 52Y, 52M, 52C, and is connected to the charging rollers 52Y, 52M, 52C connected in parallel. The second charging power supply 220 and the respective charging rollers 52Y, 52M, 52C are connected via current detection units 221, respectively. Thereby, it is possible to individually detect charging currents flowing through the charging rollers 52Y, 52M, 52C.

In a case of applying the charging voltage to the charging rollers 52Y, 52M, 52C, the control device 100 applies a predetermined voltage to the charging rollers 52Y, 52M, 52C by the second charging power supply 220 to detect the charging roller 52 through which the smallest charging current is flowing among the charging rollers 52Y, 52M, 52C, and applies the common charging voltage, at which the charging current that flows through the charging roller 52 through which the smallest charging current is flowing becomes a predetermined value, to the charging rollers 52Y, 52M, 52C by the second charging power supply 220.

The first cleaning power supply 310 is a power supply configured to apply a cleaning voltage to the cleaning roller 55K, and is connected to the cleaning roller 55K. When performing cleaning processing (which will be described later), for example, a control device 100 applies the cleaning voltage to the cleaning roller 55K by the first cleaning power supply 310, and when the cleaning processing is over, the control device 100 stops the applying of the cleaning voltage by the first cleaning power supply 310.

The second cleaning power supply 320 is a power supply common to the cleaning rollers 55Y, 55M, 55C, is configured to apply a cleaning voltage to the cleaning rollers 55Y, 55M, 55C, and is connected to the cleaning rollers 55Y, 55M, 55C connected in parallel. The second cleaning power supply 320 and the respective cleaning rollers 55Y, 55M, 55C are connected via switches 321, respectively. When the switches 321 are individually switched between ON and OFF states, the cleaning voltage to each of the cleaning rollers 55Y, 55M, 55C becomes ON or OFF.

The control device 100 is an example of the computer configured to control the respective units of the color printer 1, and is configured by a single or a plurality of electric circuits. Specifically, the control device 100 includes a CPU 110, a ROM 120, a RAM 130, an input/output circuit 140, and the like.

In the ROM 120, programs for controlling the respective units of the color printer 1 and data such as diverse setting information are stored.

The RAM 130 is used as a work area when the CPU 110 executes a variety of programs, and a temporary storage area of data.

The CPU 110 is configured to execute a variety of calculation processing based on programs and data read out from the ROM 120 and the like, signals output from diverse sensors (not shown), and the like. The control device 100 is configured to output a control signal to each unit of the color printer 1 based on a calculation result of the CPU 110, thereby controlling each unit. In other words, each unit of the color printer 1 is configured to operate, in response to the control signal output from the control device 100.

The control device 100 is configured to control each unit of the color printer 1 and to mainly perform image forming processing of forming an image on the sheet S by the image forming unit 30 and cleaning processing of collecting foreign matters on the surfaces of the charging rollers 52 by the cleaning rollers 55. The cleaning processing includes first cleaning processing and second cleaning processing. In the illustrative embodiment, the second cleaning processing also corresponds to "third cleaning processing".

The control device 100 is configured to perform the second cleaning processing for a time period different from the first cleaning processing, specifically, during the image forming processing. In the illustrative embodiment, "during the image forming processing" means a time period after the color printer 1 receives a printing job and then the control device 100 outputs a charging ON signal for enabling the second charging power supply 220 to apply a charging voltage based on the printing job until the control device 100 outputs a charging OFF signal for enabling the second charging power supply 220 to stop the applying of the charging voltage.

The second cleaning processing is processing of performing cleaning of controlling cleaning abilities of the cleaning rollers 55Y, 55M, 55C to be the same. Specifically, in the second cleaning processing, the control device 100 is configured to turn on the switches 321 to electrically connect the second cleaning power supply 320 and the respective cleaning rollers 55Y, 55M, 55C, thereby applying the same cleaning voltage to the cleaning rollers 55Y, 55M, 55C by the second cleaning power supply 320.

During the image forming processing, the control device 100 is configured to not change the cleaning voltage of the cleaning rollers 55Y, 55M, 55C. Specifically, the control device 100 is configured not to change a magnitude of the cleaning voltage to be applied to the cleaning rollers 55Y, 55M, 55C and not to switch ON and OFF states of the cleaning voltage.

The control device 100 is configured to perform the first cleaning processing while the image forming processing is not performed. Specifically, when the power supply of the color printer 1 becomes on or when the image forming processing based on the received printing job is over, the control device 100 performs the first cleaning processing in a case where a difference (hereinafter, referred to as "current difference") ΔI between a charging current flowing through the charging roller 52 through which a largest charging current is flowing among the charging rollers 52Y, 52M, 52C and a charging current flowing through the other charging rollers 52 is larger than a first threshold value ΔIth1.

The first cleaning processing is processing of performing cleaning, in which a cleaning ability of the cleaning roller 55 corresponding to the charging roller 52, at which the charging current is the largest, of the charging rollers 52Y, 52M, 52C, is lower than the cleaning abilities of the cleaning rollers 55 corresponding to the other charging rollers 52.

In the illustrative embodiment, an example where the charging current of the charging roller 52Y is the largest is described. In this case, the charging roller 52Y corresponds to "one charging roller", and the charging rollers 52M, 52C correspond to "another charging roller". In the meantime, "a charging current being larger" means that an electric resistance of the surface of the charging roller 52 is low, i.e., an amount of the foreign matters attached on the surface of the charging roller 52 is small and a degree of contamination of the charging roller 52 is low. In contrast, the description "a smaller charging current is flowing" means that an electric resistance of the surface of the charging roller 52 is high, i.e., an amount of the foreign matters attached on the surface of the charging roller 52 is large and a degree of contamination of the charging roller 52 is high.

Further, in a case where the charging current of the charging roller 52Y is the largest, the charging roller 52Y corresponds to one of "the first charging roller" and "the second charging roller", and the charging rollers 52M, 52C correspond to the other of "the first charging roller" and "the second charging roller". Also, the photosensitive drum 51Y corresponds to one of "the first photosensitive member" and "the second photosensitive member", and the photosensitive drums 51M, 51C correspond to the other of "the first photosensitive member" and "the second photosensitive member". Also, the cleaning roller 55Y corresponds to one of "the first cleaner" and "the second cleaner", and the cleaning rollers 55M, 55C correspond to the other of "the first cleaner" and "the second cleaner".

The control device 100 is configured to control the cleaning ability of the cleaning roller 55Y corresponding to the charging roller 52Y to be lower in the first cleaning processing than in the second cleaning processing. Specifically, in the first cleaning processing, the control device 100 is configured to not apply the cleaning voltage to the cleaning roller 55Y by the second cleaning power supply 320, thereby controlling the cleaning ability of the cleaning roller 55Y to be lower than in the second cleaning processing, i.e., in a case where the cleaning voltage is applied to the cleaning roller 55Y.

Also, in the first cleaning processing, in a case where the current difference ΔI is larger than a second threshold value ΔIth2 smaller than a first threshold value ΔIth1, the control device 100 applies the cleaning voltage to the cleaning rollers 55M, 55C corresponding to the charging rollers 52M, 52C by the second cleaning power supply 320.

Thereby, in the first cleaning processing, the control device 100 controls the cleaning voltage of the cleaning roller 55Y to be different from the cleaning voltage of the cleaning rollers 55M, 55C, thereby controlling the cleaning abilities to be different. Specifically, the control device 100 sets the cleaning voltage of the cleaning roller 55Y to an OFF state, and sets the cleaning voltage of the cleaning rollers 55M, 55C to an ON state in a case where the current difference ΔI is larger than the second threshold value ΔIth2, thereby controlling the cleaning ability of the cleaning roller 55Y and the cleaning abilities of the cleaning rollers 55M, 55C to be different from each other.

Also, in the first cleaning processing, in a case where the current difference ΔI is equal to or smaller than the second threshold value ΔIth2, the control device 100 does not apply the cleaning voltage to the cleaning roller 55M, 55C by the second cleaning power supply 320.

In the first cleaning processing, the control device 100 sets the cleaning voltage of the cleaning roller 55Y to an OFF state, and sets the cleaning voltage of the cleaning rollers 55M, 55C to an OFF state in a case where the current difference ΔI is equal to or smaller than the second threshold value ΔIth2, thereby ending the first cleaning processing.

When performing the first cleaning processing, the control device 100 sets a magnitude of a surface potential of the charging roller 52 to be greater than a surface potential of the photosensitive drum 51 so that the foreign matters are not moved and attached from the surface of the photosensitive drum 51 to the surface of the charging roller 52. Specifically, the control device 100 is configured to irradiate the light to the surface of the photosensitive drum 51 by the neutralization lamp 53 and to apply the charging voltage to the charging roller 52 by the second charging power supply 220. At this time, a magnitude of the charging voltage may be the same as or may be smaller, as compared to a case where the photosensitive drum 51 is charged.

Also, in the first cleaning processing, in a case of detecting and acquiring the charging current by the current detection unit 221, the control device 100 detects the charging current at a timing after a part of the surface of the photosensitive drum 51, which is neutralized by the neutralization lamp 53, reaches a position at which the part faces the charging roller 52. According to this configuration, it is possible to suppress the charges remaining on the surface of the photosensitive drum 51 after the transfer from influencing the charging current.

Also, when performing the first cleaning processing, the control device 100 moves the developing device 60 to the spaced position (refer to FIG. 3) at which the developing roller 62 is separated from the photosensitive drum 51 by the approach and separation mechanism. According to this configuration, it is possible to suppress the toner carried on the surface of the developing roller 62 from being attached to the surface of the photosensitive drum 51.

In the specification, the cleaning ability is an index indicating an amount of the foreign matters, which can be collected from the charging roller 52 by the fresh cleaning roller 55, specifically, the cleaning roller 55 that has not been worn or deteriorated and has not been used to collect foreign matters. The cleaning ability is an intrinsic performance of the cleaning roller 55 (cleaner).

As an example, the cleaning ability can be indicated by an average of amounts of foreign matters that can be collected per unit time from the charging roller 52 having a predetermined amount of foreign matters attached thereto by the fresh cleaning roller 55. Also, in a case where the cleaning roller 55 is configured to electrically collect the foreign matters by a potential difference with the charging roller 52, the cleaning ability can be said as the cleaning voltage because a voltage to be applied to the cleaning roller 55 is substantially proportional to the cleaning ability.

Subsequently, operations of the control device 100 (the control method of the color printer 1) are described.

Figure 4:
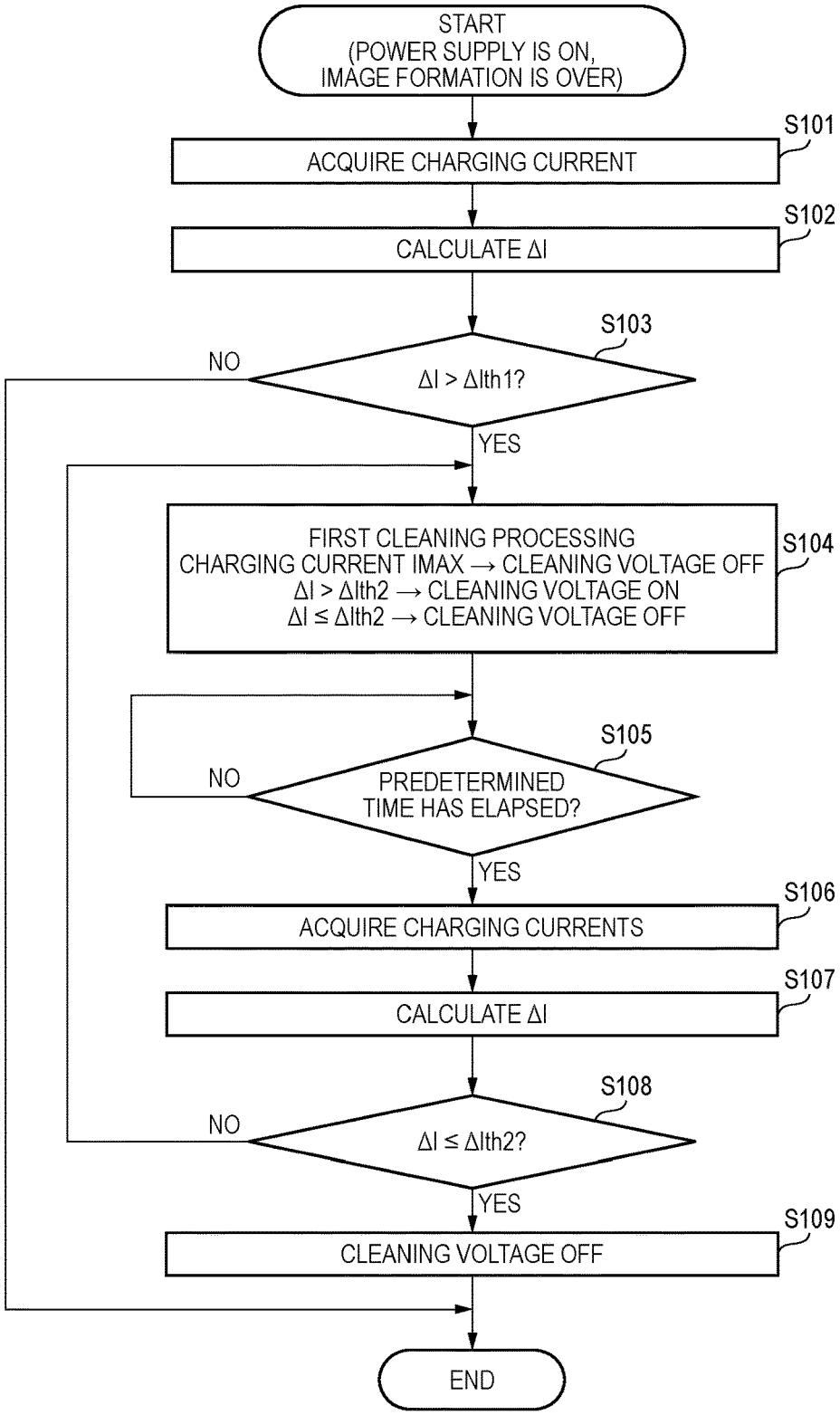
FIG. 4 is a flowchart depicting operations of the control device when the power supply becomes on or when image forming processing is over.

As shown in FIG. 4, when the power supply of the color printer 1 becomes ON or when the image forming processing is over (START), the control device 100 acquires the charging currents of the charging rollers 52Y, 52M, 52C (S101).

In the meantime, the processing of step S101 may be processing of detecting and acquiring the charging currents, which are caused to flow by applying the charging voltage to the charging rollers 52Y, 52M, 52C, after the control has started by the current detection units 221, or may be processing of reading and acquiring the charging current acquired and stored during a previous image forming processing. In the former case, it is preferable that a magnitude of the charging voltage to be applied is set to be the same as a case of charging the photosensitive drum 51 so that the charging current can be detected with the same condition as the case of charging the photosensitive drum 51. In the latter case, it is preferable that during the previous image forming processing, the surface of the photosensitive drum 51 after the transfer is neutralized by the neutralization lamp 53.

After acquiring the charging currents, the control device 100 calculates current differences ΔI (absolute values) between the largest charging current IMAX and the other charging currents, respectively (S102). In the illustrative embodiment, two current differences ΔI are calculated. For example, when the charging current flowing through the charging roller 52Y is the largest (IMAX), the charging current of the charging roller 52M is denoted as I1 and the charging current of the charging roller 52C is denoted as I2, and the first current difference ΔI1 (=|IMAX−I1|) and the second current difference ΔI2 (=|IMAX−I2|) are calculated in step S102.

After calculating the current differences ΔI, the control device 100 determines whether the current differences ΔI are larger than the first threshold value ΔIth1 (S103). In a case where both the current differences ΔI (ΔI1, ΔI2) are equal to or smaller than the first threshold value ΔIth1 (S103, No), the control device 100 ends the control of FIG. 4 without performing the first cleaning operation (END).

On the other hand, in a case where at least one of the current differences ΔI (ΔI1, ΔI2) is larger the first threshold value ΔIth1 (S103, Yes), the control device 100 performs the first cleaning processing (S104). Specifically, the control device 100 sets the cleaning voltage to an OFF state for the cleaning roller 55 corresponding to the charging roller 52 through which the largest charging current is flowing (IMAX). Also, for the cleaning rollers 55 corresponding to the charging rollers 52 through which the largest charging current is not flowing, the control device 100 sets the cleaning voltage to an ON state in a case where the current difference ΔI is larger the second threshold value ΔIth2 and sets the cleaning voltage to an OFF state in a case where the current difference ΔI is equal to or smaller than the second threshold value ΔIth2.

After a predetermined time has elapsed (S105, Yes), the control device 100 detects and acquires the charging currents of the charging rollers 52Y, 52M, 52C by the current detection units 221 (S106), and again calculates the current difference ΔI between the largest charging current IMAX and each of the other charging currents (S107). Then, the control device 100 determines whether the current differences ΔI are equal to or smaller than the second threshold value ΔIth2 (S108).

In a case where at least one of the current differences ΔI is not equal to or smaller than the second threshold value ΔIth2 (S108, No), the control device 100 proceeds to step S104 and continues to perform the first cleaning processing. On the other hand, in a case where all of the current differences ΔI are equal to or smaller than the second threshold value ΔIth2 (S108, Yes), the control device 100 sets the cleaning voltage of the cleaning rollers 55Y, 55M, 55C to the OFF state (S109), and ends the first cleaning operation (END).

Figure 5:
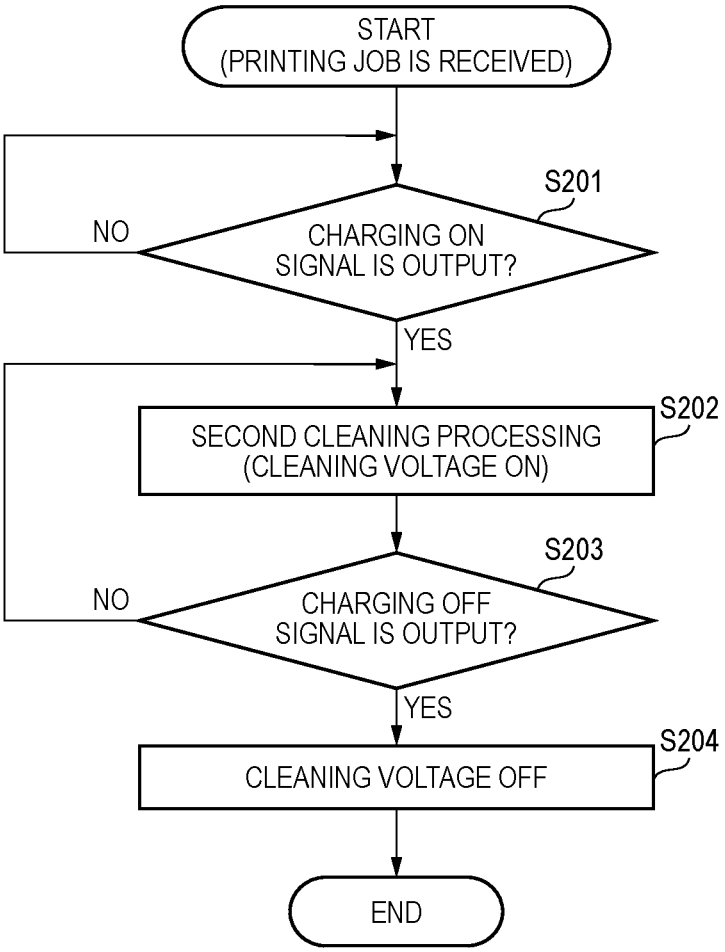
FIG. 5 is a flowchart depicting operations of the control device when a printing job is received.

Thereafter, as shown in FIG. 5, when the color printer 1 receives a printing job (START), the control device 100 performs the image forming processing. In a case where the control device 100 has output the charging ON signal to the second charging power supply 220 (S201, Yes), the control device 100 performs the second cleaning processing (S202). Specifically, the control device 100 sets the cleaning voltage of the cleaning rollers 55Y, 55M, 55C to the ON state. Then, when the final charging based on the printing job is over, the control device 100 outputs the charging OFF signal to the second charging power supply 220 (S203, Yes) to set the cleaning voltage to the OFF state (S204), and ends the second cleaning processing and the image forming processing (END). Thereafter, since the image forming processing is over, the control device 100 again starts the control of FIG. 4.

Subsequently, operational effects of the color printer 1 of the illustrative embodiment are described.

Figure 6:
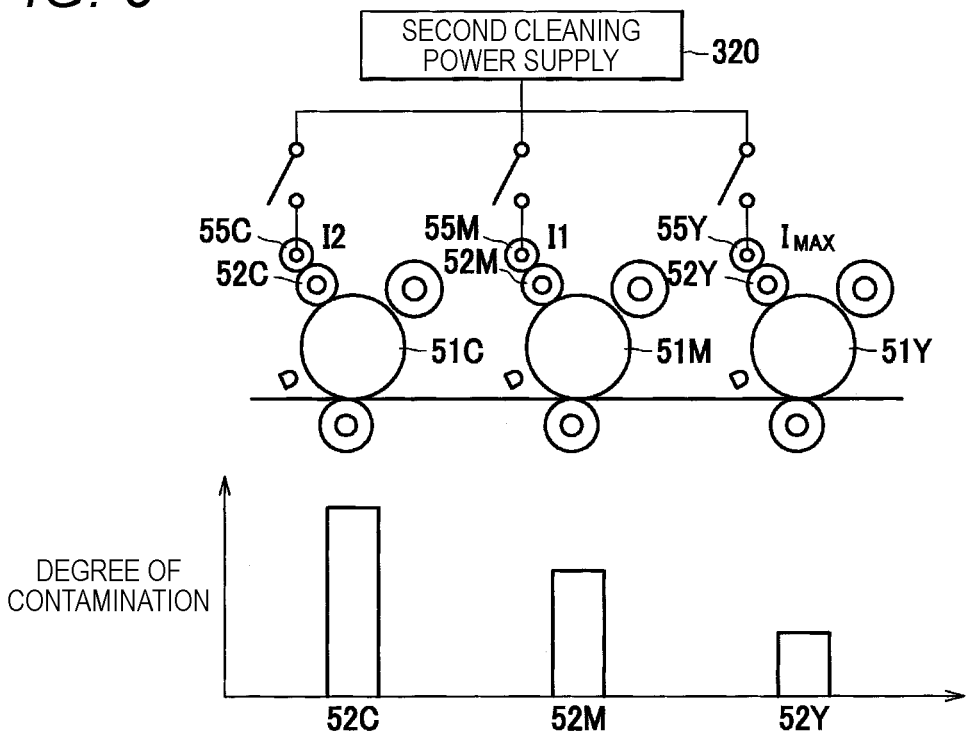
FIG. 6 illustrates an operational effect of the image forming apparatus of the illustrative embodiment, depicting a state before first cleaning processing.
Figure 7:
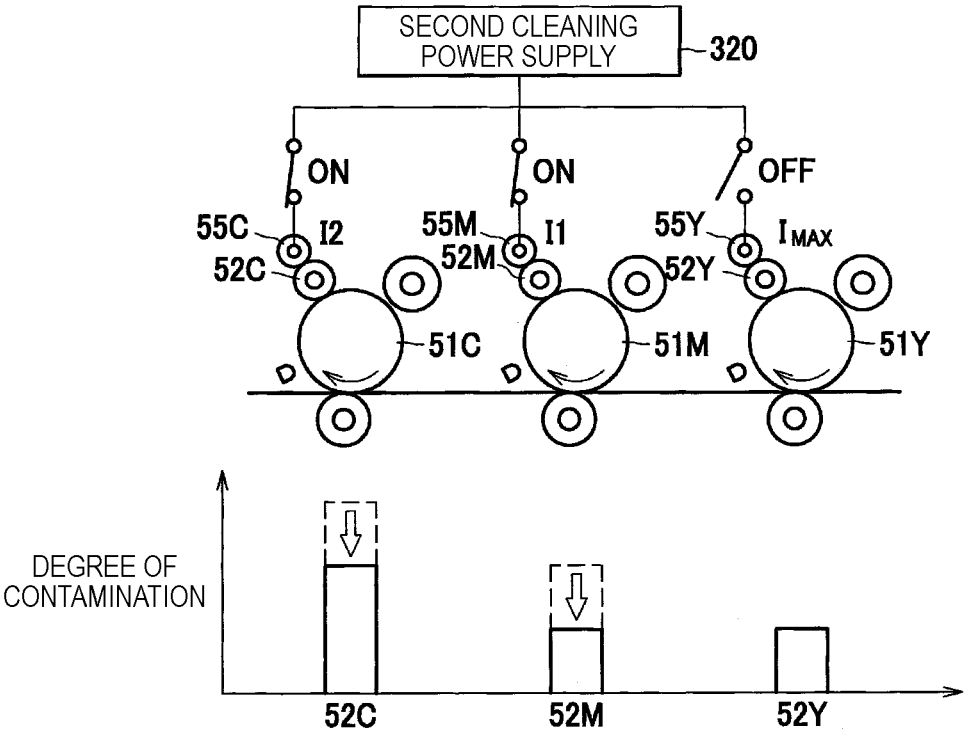
FIG. 7 illustrates an operational effect of the image forming apparatus of the illustrative embodiment, depicting a state during the first cleaning processing.

As shown in FIG. 6, in a state before the first cleaning processing is performed, and, for example, in a case where the degrees of contamination of the surfaces of the charging rollers 52Y, 52M, 52C are higher in order of the charging rollers 52Y, 52M, 52C and both the current difference ΔI between the charging current IMAX of the charging roller 52Y and the charging current I1 of the charging roller 52M and the current difference ΔI between the charging current IMAX and the charging current I2 of the charging roller 52C is larger than the first threshold value ΔIth1 (and the second threshold value ΔIth2), the first cleaning processing is started, and as shown in FIG. 7, the cleaning voltage of the cleaning roller 55Y becomes OFF and the cleaning voltage of the cleaning rollers 55M, 55C becomes ON.

Figure 8:
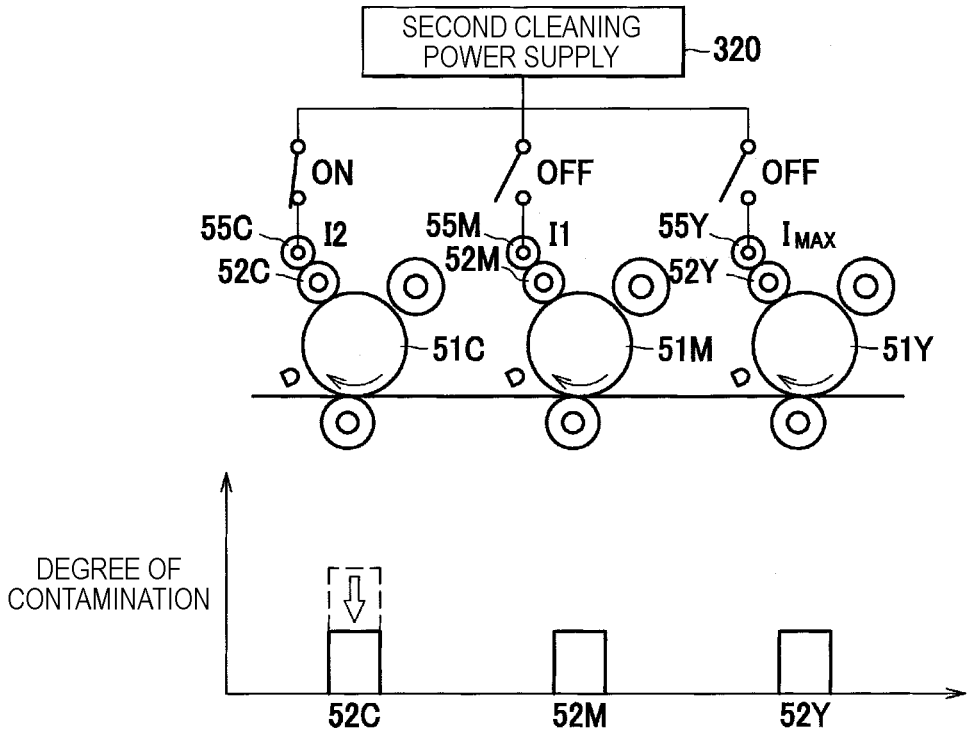
FIG. 8 illustrates an operational effect of the image forming apparatus of the illustrative embodiment, depicting a state during the first cleaning processing.

Thereby, the foreign matters on the surfaces of the charging rollers 52M, 52C are collected by the cleaning rollers 55M, 55C, and the degrees of contamination of the surfaces of the charging rollers 52M, 52C decrease. Then, in a case where the degree of contamination of the surface of the charging roller 52M becomes substantially the same as the degree of contamination of the surface of the charging roller 52Y and the current difference ΔI between the charging current IMAX and the charging current I1 of the charging roller 52M becomes equal to or smaller than the second threshold value ΔIth2, the cleaning voltage of the cleaning rollers 55Y, 55M becomes OFF and the cleaning voltage of the cleaning roller 55C is maintained at the ON state, as shown in FIG. 8.

Figure 9:
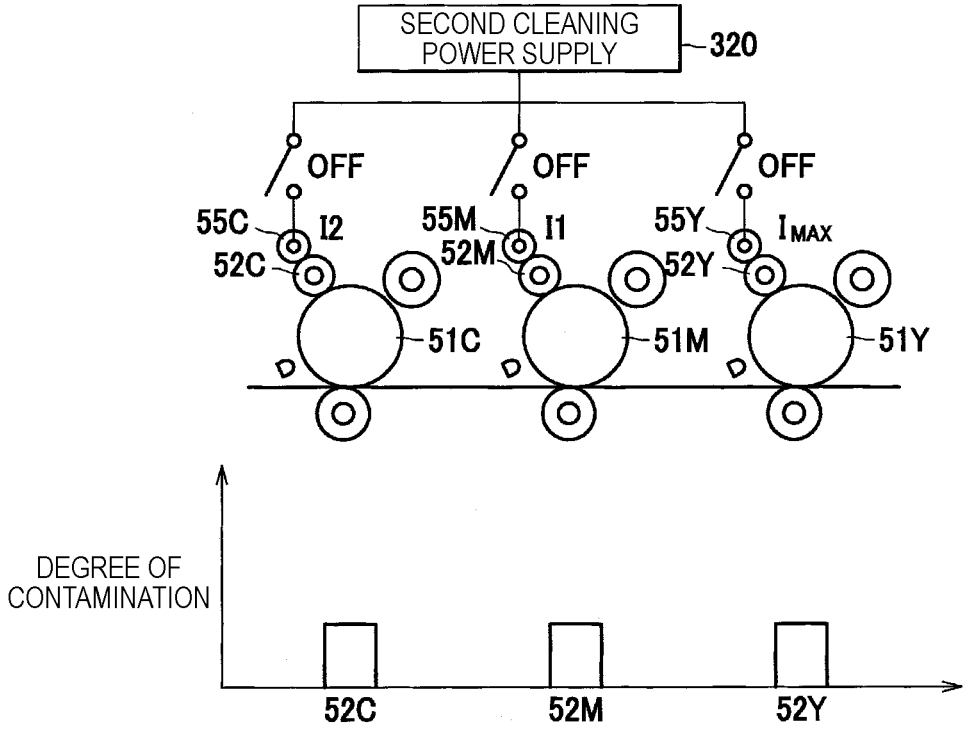
FIG. 9 illustrates an operational effect of the image forming apparatus of the illustrative embodiment, depicting a state after the first cleaning processing.

Thereafter, the foreign matters on the surface of the charging roller 52C are further collected by the cleaning roller 55C and the degree of contamination of the surface of the charging roller 52C further decreases. Then, in a case where the degree of contamination of the surface of the charging roller 52C becomes substantially the same as the degrees of contamination of the surfaces of the charging rollers 52Y, 52M and the current difference ΔI between the charging current IMAX and the charging current I2 of the charging roller 52C becomes equal to or smaller than the second threshold value ΔIth2, the cleaning voltage of the cleaning rollers 55Y, 55M, 55C becomes OFF and the first cleaning processing is over, as shown in FIG. 9.

In this way, according to the illustrative embodiment, since all the degrees of contamination of the surfaces of the charging rollers 52Y, 52M, 52C can be made to be substantially the same by the first cleaning processing, it is possible to reduce the current differences ΔI between the charging rollers 52Y, 52M, 52C. Thereby, even when the same charging voltage is applied from the common second charging power supply 220 to the charging rollers 52Y, 52M, 52C, the charging currents of the charging rollers 52Y, 52M, 52C can be made to be substantially the same and the photosensitive drums 51Y, 51M, 51C can be charged so that the surface potentials of the photosensitive drums 51Y, 51M, 51C are to be substantially the same. As a result, it is possible to favorably keep an image quality.

Also, during the image forming processing, the second cleaning processing of setting the cleaning voltage of all the cleaning rollers 55 to the ON state is performed. Therefore, unlike the first cleaning processing for reducing the current differences ΔI, it is possible to perform the cleaning for the charging rollers 52. Thereby, it is possible to reduce the foreign matters on the surface of each charging roller 52. In other words, since it is possible to collect the foreign matters on the surface of the charging rollers 52 upon image formation, which is timing at which the foreign matters are attached to the surface of the charging rollers 52, it is possible to suppress the foreign matters from being accumulated on the surfaces of the charging rollers 52 during the image formation.

Also, in the first cleaning processing, the cleaning abilities of the cleaning rollers 55Y, 55M, 55C are set to be different by setting the cleaning voltages to the ON state or the OFF state. Therefore, for example, as compared to configurations where the cleaning abilities are set to be different by controlling peripheral speed differences of the cleaning rollers 55 and the charging rollers 52 to be different or by controlling pressing forces of the cleaning rollers 55 to the charging rollers 52 to be different, it is possible to simplify the mechanical configuration of the color printer 1.

Also, the image quality is maintained higher by not changing the cleaning voltage during the image formation. That is, if the cleaning voltage is changed during the image formation, the surface potential of the charging roller 52 changes, so that the surface potential of the photosensitive drum 51 also changes and a printing density changes, thereby influencing the image quality. However, according to the illustrative embodiment, such an influence on the image quality does not occur.

Also, since the second cleaning power supply 320 is connected to the cleaning rollers 55Y, 55M, 55C, it is possible to apply the cleaning voltage to each of the cleaning rollers 55Y, 55M, 55C by one second cleaning power supply 320. Thereby, as compared to a configuration where the cleaning power supplies are separately provided and connected to the cleaning rollers 55Y, 55M, 55C, it is possible to save the cost of the color printer 1.

Also, since the first cleaning processing is over in a case where the current differences ΔI are equal to or smaller than the second threshold value ΔIth2, it is possible to end the first cleaning processing at timing earlier than the timing at which the foreign matters on the surfaces of the charging rollers 52Y, 52M, 52C are completely collected. Thereby, it is possible to shorten the time until the cleaning operation associated with the first cleaning processing is over. In other words, it is possible to shorten a waiting time period after the power supply of the color printer 1 becomes on or a waiting time period from when the previous image formation is over to when image formation is possible.

Although the illustrative embodiment of the present disclosure has been described, the present disclosure is not limited to the illustrative embodiment. The specific configurations can be appropriately changed without departing from the spirit of the present disclosure.

For example, when the power supply of the color printer 1 is turned on or when the image forming processing is over, the control device 100 may first perform cleaning processing before the first cleaning processing. In the cleaning processing before the first cleaning processing, the foreign matters on the surfaces of the charging rollers 52Y, 52M, 52C are collected by setting all of the cleaning voltages of the cleaning rollers 55Y, 55M, 55C to the ON state and controlling the cleaning abilities of the cleaning rollers 55Y, 55M, 55C to be the same cleaning ability. After a predetermined time has elapsed from the cleaning processing before the first cleaning processing, the control device 100 may acquire the charging currents, and then perform the first cleaning processing in a case where the current difference ΔI becomes larger than the first threshold value ΔIth1.

Also, in the illustrative embodiment, in a case of applying the charging voltage, the charging voltage is controlled based on the charging current of the charging roller 52 through which the smallest charging current is flowing among the charging rollers 52Y, 52M, 52C. However, the present disclosure is not limited thereto. For example, the charging roller 52 which the controlling is based on may be the charging roller 52 through which the largest charging current is flowing, may be the charging roller 52 through which the charging current of an intermediate value, which is neither the largest or smallest value, among the three values is flowing, or may be one charging roller 52 which has been determined in advance irrespective of the charging current.

Also, in the illustrative embodiment, one second cleaning power supply 320, which is the "cleaning power supply", is provided for the cleaning rollers 55Y, 55M, 55C, and is connected to the three cleaning rollers 55Y, 55M, 55C. However, the present disclosure is not limited thereto. For example, only one cleaning power supply may be provided for the cleaning rollers 55Y, 55M, 55C, 55K and may be connected to the four cleaning rollers 55Y, 55M, 55C, 55K. In this case, for example, it is possible to perform the first cleaning processing as described in the illustrative embodiment for the four cleaning rollers 55 including the cleaning roller 55K.

Also, the cleaning power supply may be provided for each of the cleaning rollers 55. According to this configuration, it is possible to change the magnitude of the cleaning voltage to be applied to each of the cleaning rollers 55. Thereby, for example, in the first cleaning processing, a magnitude of the cleaning voltage to be applied to the cleaning roller 55 corresponding to the charging roller 52 through which a smaller charging current is flowing (the degree of contamination is high) among the two cleaning rollers 55 may be controlled to be the same as that in the second cleaning processing so as to maintain the cleaning ability, and a magnitude of the cleaning voltage to be applied to the cleaning roller 55 corresponding to the charging roller 52 through which the larger charging current is flowing (the degree of contamination is low) may be controlled to be lower than that in the second cleaning processing so as to lower the cleaning ability.

Also, in the illustrative embodiment, the control device 100 is configured to control the cleaning ability of the cleaning roller 55, which corresponds to the charging roller 52 through which the larger charging current is flowing, to be lower in the first cleaning processing than in the second cleaning processing. However, the present disclosure is not limited thereto. For example, the control device 100 may be configured to control the cleaning ability of the cleaning roller 55, which corresponds to the charging roller 52 through which the lower charging current is flowing, to be higher in the first cleaning processing than in the second cleaning processing.

Specifically, the magnitude of the cleaning voltage to be applied to each of the cleaning rollers 55 may be changed, and in the first cleaning processing, a magnitude of the cleaning voltage to be applied to the cleaning roller 55 among the two cleaning rollers 55, which corresponds to the charging roller 52 through which the larger charging current is flowing (the degree of contamination is low), may be controlled to be the same as that in the second cleaning processing so that the cleaning ability is maintained, and a magnitude of the cleaning voltage to be applied to the cleaning roller 55, which corresponds to the charging roller 52 through which the lower charging current is flowing (the degree of contamination is high), may be controlled to be higher than that in the second cleaning processing so that the cleaning ability is high.

Also, in the illustrative embodiment, the color printer 1 is configured so that the second charging power supply 220, which is the "charging power supply", applies the same charging voltage to the three charging rollers 52Y, 52M, 52C. However, the present disclosure is not limited thereto. For example, the charging power supply may be configured to apply the same charging voltage to the four charging rollers 52Y, 52M, 52C, 52K.

Also, in the illustrative embodiment, in the first cleaning processing, the cleaning voltage is changed to control the cleaning abilities of the cleaning rollers 55 to be different from each other. However, the present disclosure is not limited thereto. For example, the cleaning abilities may be controlled to be different by changing the pressing forces of the cleaning rollers 55 to the charging roller 52. Also, like the configuration disclosed in JP-A-2015-001656, the cleaning abilities may be controlled to be different by changing the peripheral speed differences between the cleaning rollers 55 and the charging rollers 52.

Also, the methods of controlling the cleaning abilities to be different may be appropriately combined. For example, in case where the difference of the degrees of contamination is not reduced simply by changing the cleaning voltage, the peripheral speed difference between the cleaning roller 55 and the charging roller 52 may be additionally changed. Also, for example, in a case where the current difference is larger than a third threshold value larger than the first threshold value, i.e., the difference of the degrees of contamination between the charging rollers is greater, the cleaning ability may be controlled to be higher by changing both the cleaning voltage of the cleaning roller 55 corresponding to the charging roller 52 at which the degree of contamination is high and the peripheral speed difference between the cleaning roller 55 and the charging roller 52 at which the degree of contamination is high.

Also, in case that the difference of the degrees of contamination is not reduced simply by changing the cleaning voltage, the time period for which the cleaning processing is performed may be extended.

In the meantime, in a case where the cleaning roller 55 (cleaner) is configured to rub the surface of the charging roller 52 so as to physically collect the foreign matters, it is possible to say that the cleaning ability is a relative speed or pressing force of the cleaning roller 55 to the charging roller 52.

Also, the timings of performing the first cleaning processing and the second cleaning processing described in the illustrative embodiment are just exemplary, and the present disclosure is not limited to the illustrative embodiment. For example, the first cleaning processing (of determining whether the current difference is larger than the first threshold value) may be performed after the image forming processing based on the printing job is performed for a predetermined number of times. Also, in this case, the second cleaning processing may be performed at any timing at which the first cleaning processing is not performed, after the image forming processing is over. That is, the second cleaning processing may be processing different from the third cleaning processing that is performed during the image formation.

Also, in the illustrative embodiment, the photosensitive drum 51, i.e., the drum-shaped photosensitive member has been exemplified as the photosensitive member. However, the present disclosure is not limited thereto. For example, a belt-shaped photosensitive member or the like may also be used.

Also, in the illustrative embodiment, the surface layer of the cleaning roller 55 is configured by the conductive urethane rubber layer. However, the present disclosure is not limited thereto. For example, the surface layer of the cleaning roller may be configured by any conductive material, such as silicone rubber layer, urethane or silicone sponge layer and the like.

Also, in the illustrative embodiment, the cleaning roller 55, i.e., the roller-shaped cleaner has been exemplified as the cleaner. However, the present disclosure is not limited thereto. For example, a brush-shaped or block-shaped cleaner and the like may also be used.

Also, in the illustrative embodiment, the present disclosure is applied to the image forming apparatus configured to use the positively charged toners. However, the present disclosure is not limited thereto. For example, the present disclosure can also be applied to an image forming apparatus configured to use negatively charged toners. In this case, the polarities of charging voltage, the cleaning voltage and the like may be changed in conformity to the polarity of the toner, and the magnitudes (absolute values) thereof may be set in the similar manner to the illustrative embodiment.

Also, when implementing the present disclosure, the respective elements described in the illustrative embodiment and modified embodiments can be arbitrarily combined.

What is claimed is:

1. An image forming apparatus comprising:

a first photosensitive member;

a second photosensitive member;

a first charging roller configured to charge the first photosensitive member;

a second charging roller configured to charge the second photosensitive member;

a first cleaner configured to collect foreign matter on a surface of the first charging roller;

a second cleaner configured to collect foreign matter on a surface of the second charging roller;

a charging power supply common to the first charging roller and the second charging roller and configured to apply a same charging voltage to the first charging roller and the second charging roller; and a control device configured to, in a case where a difference between a charging current flowing through the first charging roller and a charging current flowing through the second charging roller is larger than a first threshold value, perform first cleaning processing in which a cleaning ability of one cleaner of the first cleaner and the second cleaner, which corresponds to one of the first charging roller and the second charging roller, is lower than a cleaning ability of another cleaner of the first cleaner and the second cleaner, which corresponds to another of the first charging roller and the second charging roller, a charging current flowing through the one charging roller being larger than a charging current flowing through the other charging roller.

2. The image forming apparatus according to claim 1, wherein, during a time period at which the first cleaning processing is not performed, the control device is configured to perform second cleaning processing of controlling a cleaning ability of the first cleaner and a cleaning ability of the second cleaner to be the same cleaning ability.

3. The image forming apparatus according to claim 2, wherein the control device is configured to change the cleaning ability of the one cleaner to be lower in the first cleaning processing than in the second cleaning processing.

4. The image forming apparatus according to claim 2, wherein the control device is configured to change the cleaning ability of the other cleaner to be higher in the first cleaning processing than in the second cleaning processing.

5. The image forming apparatus according to claim 1, further comprising at least one cleaning power supply configured to apply a cleaning voltage which has a same polarity as the charging voltage and an absolute value larger than the charging voltage to the first cleaner and the second cleaner, wherein, in the first cleaning processing, the control device is configured to change at least one of a cleaning ability of the first cleaner and a cleaning ability of the second cleaner to be different from each other by changing at least one of a cleaning voltage applied to the first cleaner and a cleaning voltage applied to the second cleaner by the cleaning power supply to be different from each other.

6. The image forming apparatus according to claim 5, wherein the control device is configured to not change the cleaning voltage applied to the first cleaner and the cleaning voltage applied to the second cleaner by the cleaning power supply during image forming processing of forming an image on a recording sheet.

7. The image forming apparatus according to claim 6, wherein, during the image forming processing, the control device is configured to perform third cleaning processing of applying the cleaning voltage to both the first cleaner and the second cleaner by the cleaning power supply.

8. The image forming apparatus according to claim 5, wherein, in the first cleaning processing, the control device is configured to not apply the cleaning voltage to the one cleaner by the cleaning power supply, and wherein, in the first cleaning processing, the control device is configured to apply the cleaning voltage to the other cleaner by the cleaning power supply in a case where the difference between the charging current flowing through the first charging roller and the charging current flowing through the second charging roller is larger than a second threshold value smaller than the first threshold value, and not apply the cleaning voltage to the other cleaner by the cleaning power supply in a case where the difference is equal to or smaller than the second threshold value.

9. The image forming apparatus according to claim 8, further comprising:

a first switch electrically connecting the first cleaner and the cleaning power supply, and a second switch electrically connecting the second cleaner and the cleaning power supply, wherein the control device is configured to apply the cleaning voltage to each cleaner by maintaining each switch in an ON state, and not apply the cleaning voltage to each cleaner by maintaining each switch in an OFF state, wherein, in the first cleaning processing, the control device is configured to maintain one of the first switch and the second switch, which corresponds to the one cleaner, in the OFF state, wherein, in a case where the difference is larger than the second threshold value in the first cleaning processing, the control device is configured to maintain another of the first switch and the second switch, which corresponds to the other cleaner, in the ON state, and wherein, in a case where the difference is equal to or smaller than the second threshold value in the first cleaning processing, the control device is configured to maintain the other of the first switch and the second switch, which corresponds to the other cleaner, in the ON state.

10. The image forming apparatus according to claim 5, wherein the cleaning power supply is connected to both the first cleaner and the second cleaner.

11. The image forming apparatus according to claim 1, wherein the control device is configured to end the first cleaning processing in a case where the difference between the charging current flowing through the first charging roller and the charging current flowing through the second charging roller is equal to or smaller than a second threshold value smaller than the first threshold value.

12. A control method for controlling an image forming apparatus including: a first photosensitive member; a second photosensitive member; a first charging roller configured to charge the first photosensitive member; a second charging roller configured to charge the second photosensitive member; a first cleaner configured to collect foreign matter on a surface of the first charging roller; a second cleaner configured to collect foreign matter on a surface of the second charging roller; and a charging power supply common to the first charging roller and the second charging roller and configured to apply a same charging voltage to the first charging roller and the second charging roller, the method comprising:

in a case where a difference between a charging current flowing through the first charging roller and a charging current flowing through the second charging roller is larger than a first threshold value, performing first cleaning processing in which a cleaning ability of one cleaner of the first cleaner and the second cleaner, which corresponds to one of the first charging roller and the second charging roller, is lower than a cleaning ability of another cleaner of the first cleaner and the second cleaner, which corresponds to another of the first charging roller and the second charging roller, a charging current flowing through the one charging roller being larger than a charging current flowing through the other charging roller.

* * * * *